US005871298A

United States Patent [19]

Lekhtman et al.

[11] Patent Number: 5,871,298

[45] Date of Patent: Feb. 16, 1999

[54] EXERCISE BOOT

[76] Inventors: David Lekhtman, 245 Antoine Villeray, Beaconsfield, Quebec, Canada, H9W 6E8; Semyon Ioffe, 500 Boreham Blvd., Winnipeg, Manitoba, Canada, R3P 0K1

[21] Appl. No.: 870,911

[22] Filed: Jun. 6, 1997

[51] Int. Cl.[6] ..... A63B 25/08

[52] U.S. Cl. ..... 402/77; 482/79

[58] Field of Search ..... 482/77, 79

[56] References Cited

U.S. PATENT DOCUMENTS 4,492,374 1/1985 Lekhtman et al. .
5,205,798 4/1993 Lekhtman .

*Primary Examiner*—Lynne A. Reichard

[57] ABSTRACT

An exercise boot comprises a foot receiving member and a spring member positioned under the foot receiving member. The foot receiving member is formed of a unitary flexible piece of material which has integrally joined left and right symmetrical portions and which has been brought together. The spring member comprises identical top and bottom arcuate layers connected in an opposed relationship by a resilient strap and each defining a central slot. The symmetrical portions are provided with base portions which form a sole in the foot receiving member for supporting a wearer's foot and provided with hooks for engaging the slot of the top arcuate layer and thus secure the foot receiving member to the spring member while retaining the left and right symmetrical portions together in a boot configuration and in a way that most of the springiness of the top arcuate member is retained where it is connected to the foot receiving member. A ground engaging sole which defines an interrupted rib inserted in the slot of the bottom arcuate layer is further secured thereto with a pair of bands.

20 Claims, 6 Drawing Sheets

48
50
52
46
48
50
52
48

48
46a
48

48
46b
48

48
46c
48

EXERCISE BOOT

BACKGROUND OF INVENTION

1. Field of invention

The present invention relates to an exercise boot and, more particularly, to a foot receiving member which has a spring member assembled at the bottom thereof.

2. Description of Prior Art

U.S. Pat. Nos. 4,492,374 issued on Jan. 8, 1985 to Lekhtman et al. and No. 5,205,789 issued on Apr. 27, 1993 to Lekhtman each disclose a sporting and exercising boot which comprises a foot receiving member and an oval shaped spring member attached to the bottom of the foot receiving member. The spring member includes top and bottom arched layers which are joined together at corresponding ends thereof by a spring rate and weight adjustment mechanism extending between the top and bottom arched members.

The oval shaped spring member described in U.S. Pat. No. 4,492,374 is permanently attached to the foot receiving member. It is noted that the nature of the attachment of the top and bottom arched layers does not allow for the oval shaped spring member to disassemble under condition of extraordinary lateral force.

The top arched layer of the oval shaped spring member disclosed in U.S. Pat. No. 5,205,789 is detachably fastened to the sole of the foot receiving member by two screws which extend through openings defined in the top arched layer and into the foot receiving member. The spring member is provided with a sole which is detachably mounted to the bottom surface of the bottom arched layer by screws; alternatively, the sole can be attached to the bottom arched layer by inserting the ends of the sole into respective pockets defined near the ends of the bottom arcuate layer.

SUMMARY OF INVENTION

It is therefore an aim of the present invention to provide an exercise boot having a foot receiving member which is relatively simple and economical to manufacture.

It is also an aim of the present invention to provided an exercise boot wherein the foot receiving member is adjustable to receive different shoe sizes.

It is a further aim of the present invention to provide an exercise boot having a spring member comprised of top and bottom arcuate layers, wherein the top arcuate member is attached to the foot receiving member in such a way as to retain at least most of its springiness.

It is a still further aim of the present invention to provide a spring member having identical top and bottom arcuate layers adapted to be attached with novel connections respectively to the foot receiving member and to a ground engaging sole.

It is a still further aim of the present invention to provide the spring member with a resilient strap which connects the top and bottom arcuate layers together.

Therefore, in accordance with the present invention, there is provided an exercise boot comprising a foot receiving member and a spring member positioned under said foot receiving member, said foot receiving member being adapted for receiving a wearer's foot, said spring member comprising upper and lower resilient members and being adapted to be mounted with non rigid connection means to said foot receiving member at said upper resilient member such that said upper resilient member retains at least most of its springiness at said connection means.

Also in accordance with the present invention, there is provided an exercise boot comprising a foot receiving member and a spring member under said foot receiving member, said foot receiving member being formed of a flexible piece of material having left and right portions which, when forming a boot configuration, define a foot supporting base, and connection means for connecting said left and right portions to said spring member while retaining said left and right portions in said boot configuration.

Further in accordance with the present invention, there is provided an exercise boot comprising a foot receiving member and a spring member positioned under said foot receiving member. The foot receiving member is provided with at least two series of fin means extending inwardly from opposed lateral sides of the foot receiving member at a rear portion thereof, substantially opposite a counter of a user's footwear. Each series of fin means has a height which generally decreases towards a front portion of the foot receiving member thereby enabling the foot receiving member to accommodate various sizes of footwear.

BRIEF DESCRIPTION OF THE DRAWINGS

Having thus generally described the nature of the invention, reference will know be made to the accompanying drawings, showing by way of illustration a preferred embodiment thereof and in which.

DESCRIPTION OF THE PREFERRED EMBODIMENTS

Figure 1:
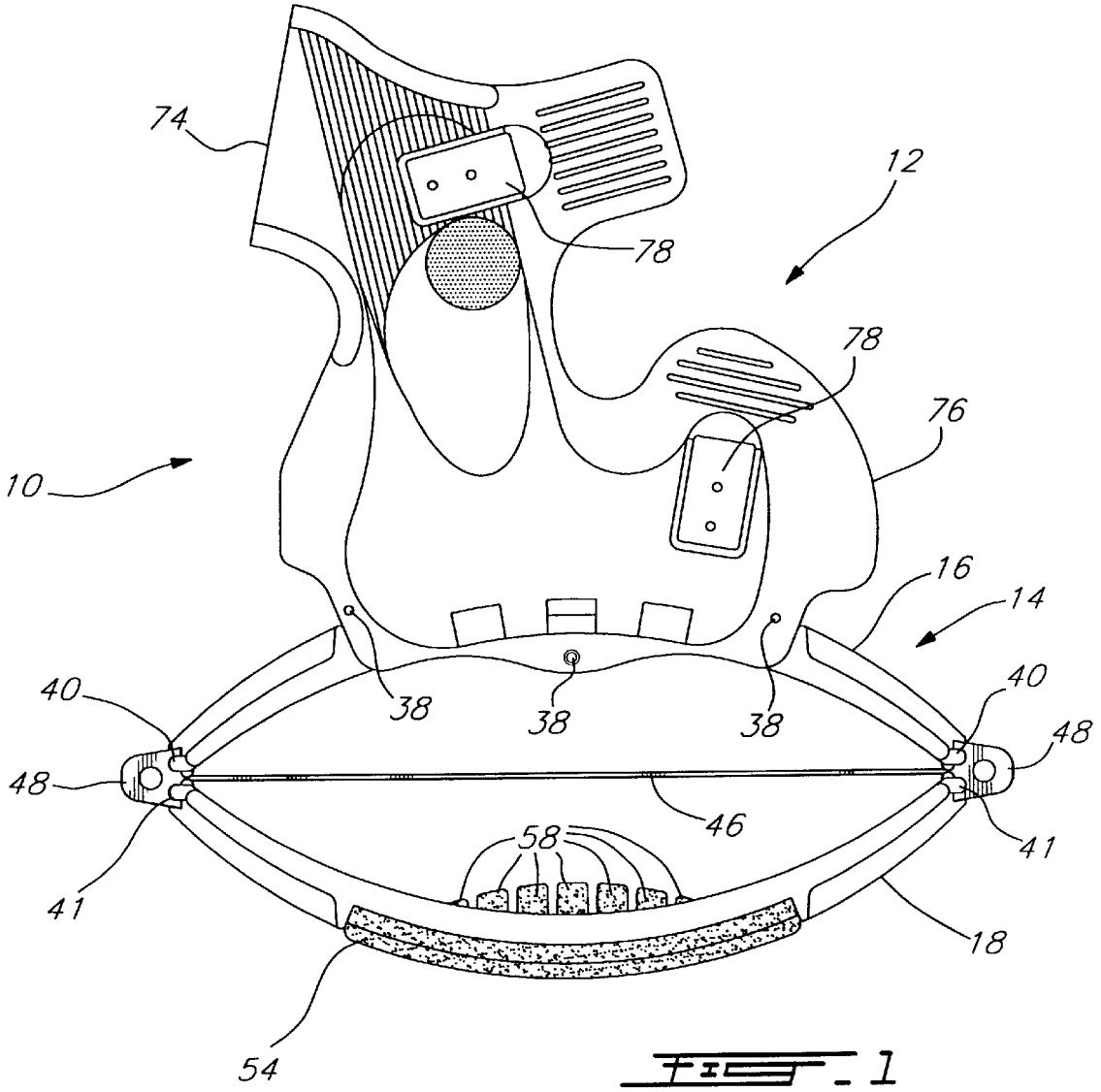
FIG. 1 is a side elevational view of an exercise boot in accordance with the present invention and comprised of a foot receiving member and a spring member.

With reference to the drawings and, more particularly, to FIG. 1, an exercise boot embodying the elements of the present invention and generally designated by the numeral 10 will be described.

More specifically, the exercise boot 10 comprises a foot receiving member 12 and a spring member 14 connected thereunder. The spring member 14 includes identical top and bottom arcuate layers 16 and 18 joined to each other at the ends thereof in an oval shape. The spring member 14 is removably mounted to the bottom of the foot receiving member 12, as will be described in detail hereinbelow.

Figures 2, 14:
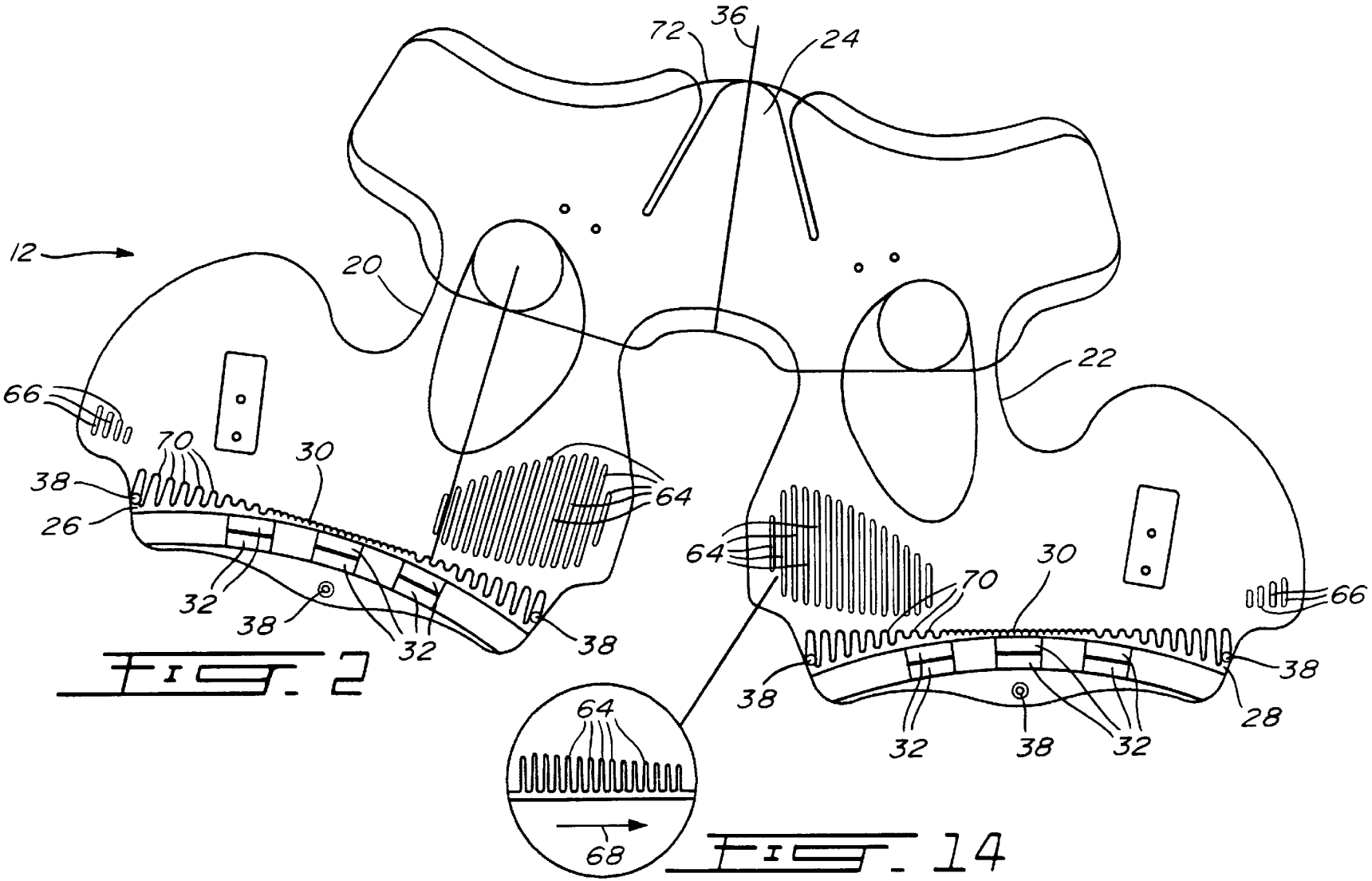
FIG. 2 is a front elevational view of the foot receiving member of the exercise boot of FIG. 1 shown in an extended molded position.
FIG. 14 is a detailed view of the extended foot receiving member of FIG. 2 showing fins thereof extending inwardly from below the ankle area of the foot receiving member.
Figure 3:
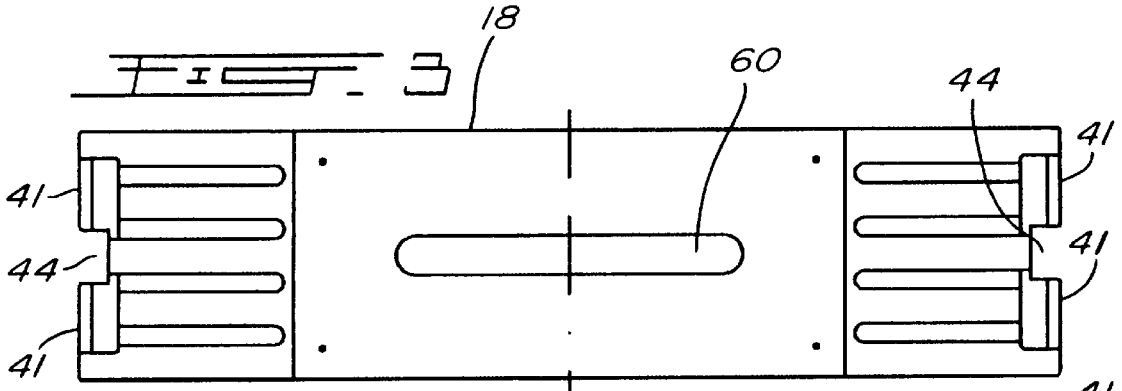
FIG. 3 is a top plan view of a bottom arcuate layer of the spring member, a top arcuate layer of the spring member being identical.
Figures 6, 7, 8:
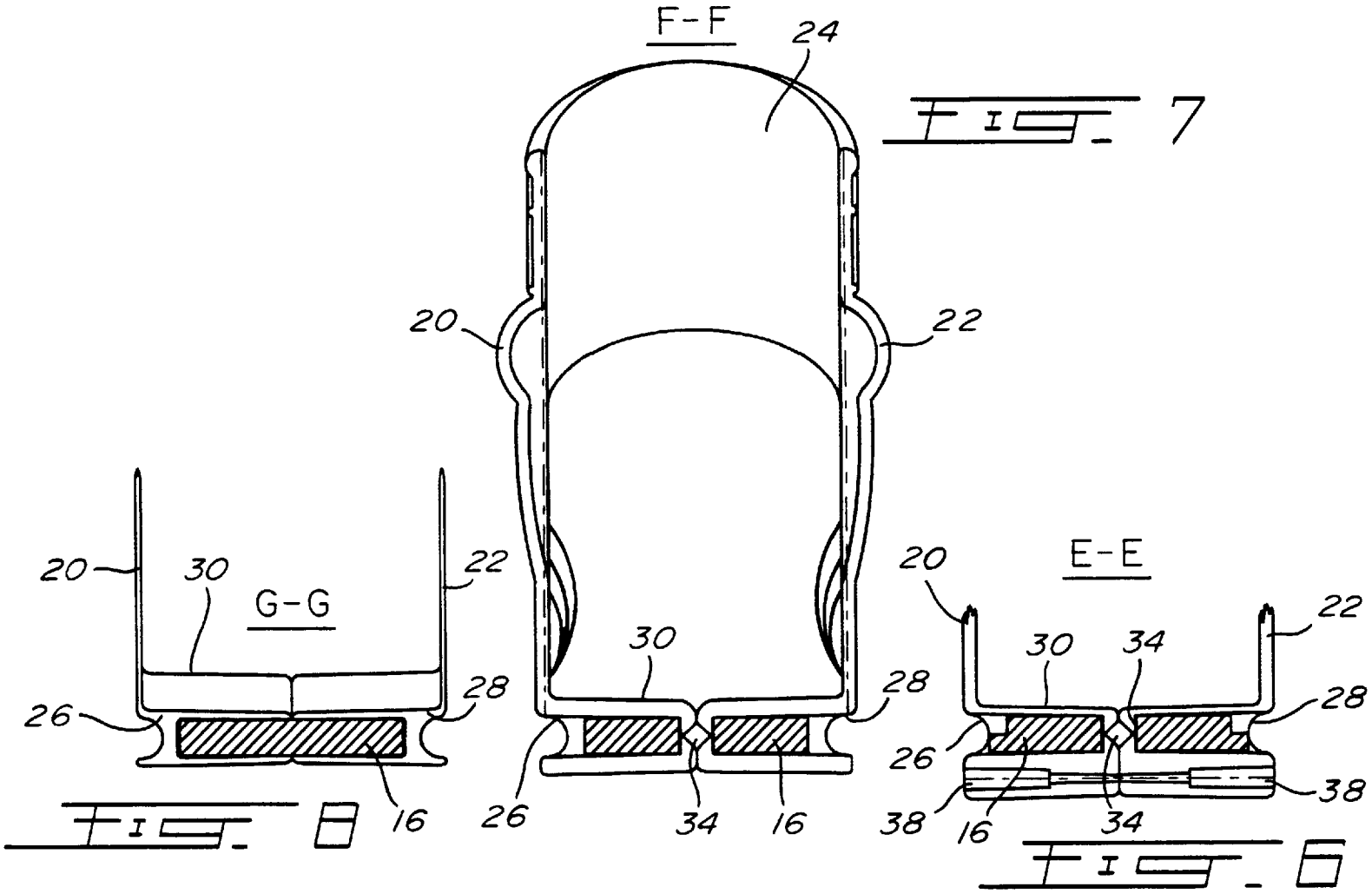
FIG. 6 is a cross-sectional view taken along line E—E of FIG. 5 showing a connection of the foot receiving member to the top arcuate layer of the spring member.
FIG. 7 is a cross-sectional view taken along line F—F of FIG. 5.
FIG. 8 is a cross-sectional view taken along line G—G of FIG. 5.

As shown in FIG. 2, the foot receiving member 12 is molded in a single piece of flexible material which is formed of two symmetrical parts, namely a left portion 20 and a right portion 22, which are integrally connected at upper end thereof by a web portion 24. The foot receiving member 12 is made of a flexible material such as a plastics material. The left and right portions 20 and 22 are provided with respective integral base portions 26 and 28 which extend substantially horizontally therefrom, inwardly of the foot receiving member 12. As best seen in FIGS. 2 and 5 to 8, the base portions 26 and 28 have upper surfaces which together provide a sole 30 for supporting a wearer's foot when the foot receiving member 12 is folded or collapsed, as in FIGS. 1 and 7, in a bootshaped configuration. The base portions 26 and 28 each include a bottom arcuate section which defines three pairs of hook members 32 for engaging a slot 34 which extends centrally and longitudinally along a portion of the top arcuate layer 16 (see slot 60 of identical bottom arcuate layer 18 of FIG. 3). The two sets of three pair of hook members 32 are designed to accommodate therebetween transversal sections of the top arcuate layer 16 extending on both sides of the slot 34, as shown in FIGS. 6 and 7.

Accordingly, the foot receiving member 12 is formed by bending the single piece of flexible material along a symmetry axis 36 (see FIG. 2) extending through the web portion 24 interconnecting the left and right portions 20 and 22 of the foot receiving member 12 and by forcing the hook members 32 of each base portion 26 and 28 to engage the slot 34 defined in the top arcuate layer 16. Basically, the top arcuate layer 16 is first positioned between the left and right portions 20 and 22 which are then brought inwardly such that the aforementioned transversal sections of the top arcuate layer 16 slide between the hook members 32 until the hook members 32 become engaged in the slot 34. Therefore, as best seen in FIGS. 6 and 7, the hook members 32 and the slot 34 cooperate to hold the base portions 26 and 28 together in a boot configuration and also to interconnect the foot receiving member 12 (in its collapsed functional position of FIGS. 1 and 7) and the spring member 14 in a secure assembly.

As best seen in FIGS. 6 to 8 and especially FIG. 8, the base portions 26 and 28 define a transversely rectangular and longitudinally arcuate (see FIG. 5) channel through which is inserted the top arcuate layer 16 and in which the hook members 32 engage the slot 34. With this configuration, the springiness of the top arcuate layer 16 is mostly retained even where it is connected to the foot receiving member 12 as the engagement of the hook members 32 in the slot 34 does not produce a rigid connection as it is the case with the screws used in the prior art. Indeed, in conventional exercise boots, the spring members are rigidly connected to the boots thereby greatly reducing the upper arcuate member's ability to elastically deform and thus also reducing the overall springiness of the spring member. In the present invention, the mechanism used to mount the spring member 14 to the foot receiving member 12, that is the hook members 32 and the slot 34, constitutes a non rigid connection which allows for the top arcuate member 16 to retain its springiness at this point of connection.

Once the base portions 26 and 28 have been assembled to the top arcuate layer 16 as described hereinabove, they are fastened together by screws (not shown) which extend through holes 38 defined in each base portion 26 and 28 and into material of the base portions 26 and 28, as shown in FIG. 6. A single screw inserted in a single hole from one side of the foot receiving member 12 may be used.

The top and bottom arcuate layers 16 and 18 are identical and made of a flexible material such as a hard flexible plastics material. The top arcuate layer 16 is provided at each end thereof with a horizontal projection or ledge 40 from which extend a pair of nipples 42. Similarly, the bottom arcuate layer 18 is provided at each end thereof with a horizontal projection 41 from which extend a pair of nipples 43. A rectangular indent or notch 44 is defined in the center part of each horizontal projection 40 and 41.

Figures 9, 10A, 10B, 10C:
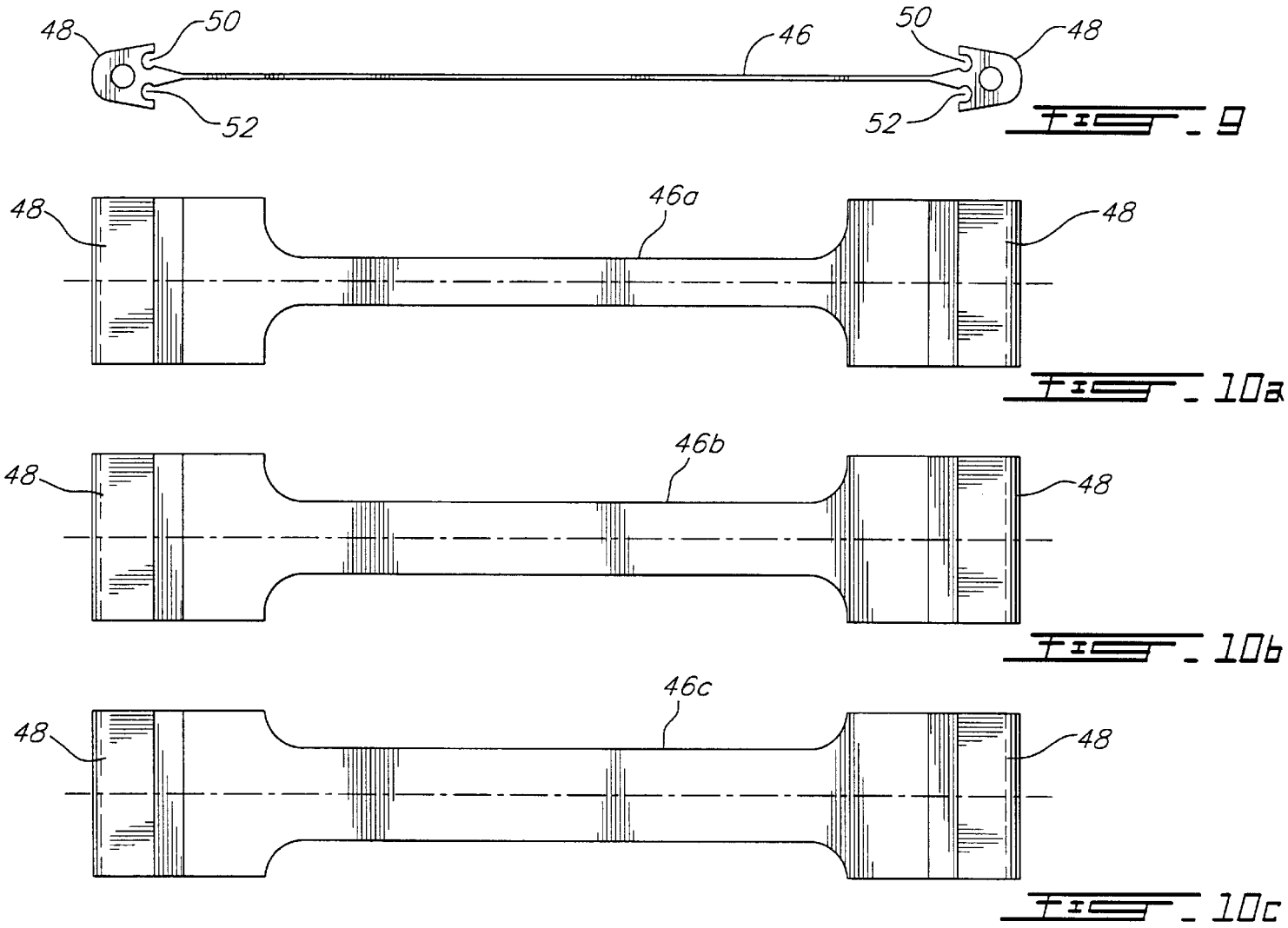
FIG. 9 is a side elevational view of a strap of the spring member.
FIGS. 10*a* to 10*c* are top plan views of straps as in FIG. 9 but having different widths.

Now referring to FIGS. 1 and 9, a spring rate and weight adjustment means in the form of a resilient rubber or plastic strap 46 is disposed between the top and bottom arcuate layers 16 and 18. The strap 46, as best seen in FIGS. 10*a* to 10*c*, may have different widths such as to allow for various spring forces. For instance, an intermediate strap 46*b* is used for a medium spring resistance. To provide a greater resistance, or to support a greater weight, a heavier and thicker strap 46*c* is used. Alternatively, to provide less resistance and to support a smaller weight, a lighter and thinner strap 46*a* is used. Therefore, the exercise boot 10 is adaptable to a wide range of weights and/or desired resistance.

More particularly, the strap 46 is provided at each end thereof with an integral hook member 48 which defines top and bottom grooves 50 and 52 to respectively receive the horizontal projections 40 and 41 protruding from facing ends of the top and bottom arcuate layers 16 and 18, respectively. Each groove 50 and 52 is interrupted by a protruding step (not shown) which is disposed centrally of the groove and which has a width corresponding to the width of the notches 44. Therefore, each step can be fitted into a corresponding notch 44 to prevent the lateral movement of the top and bottom arcuate layers 16 and 18 relative to the strap 46 when submitted to small or normal lateral forces. This arrangement also centers the strap 46 with respect to both arcuate layers 16 and 18.

When the spring member 14 is assembled, as shown in FIG. 1, the portion of each hook member extending between respective top and bottom grooves 50 and 52 will extend transversely between the nipples 42 and 43 which outwardly abut respective edges of the hook member 48. Therefore, the nipples 42 and 43 also contribute in preventing lateral movements of the top and bottom arcuate layers 16 and 18 with respect to the strap 46 under small lateral forces.

However, if a strong lateral force is exerted on the spring member 14, this strong lateral force will overcome the holding restraint provided by the nipples 42 and 43 and by the notches 44 on the hook members 48 thereby permitting lateral movement of the top and bottom arcuate layers 16 and 18 relative to the strap 46. Accordingly, the strap 46 and the bottom arcuate layer 18 will detach from the top arcuate layer 16 and the user will thus step on the relatively flat surfaces of the top arcuate layer 16 provided by its horizontal projections 40 to thereby avoid injuries. Therefore, the automatic disassembly of the spring member 14 under the influence of a high lateral force provides a safety feature.

Figure 11:
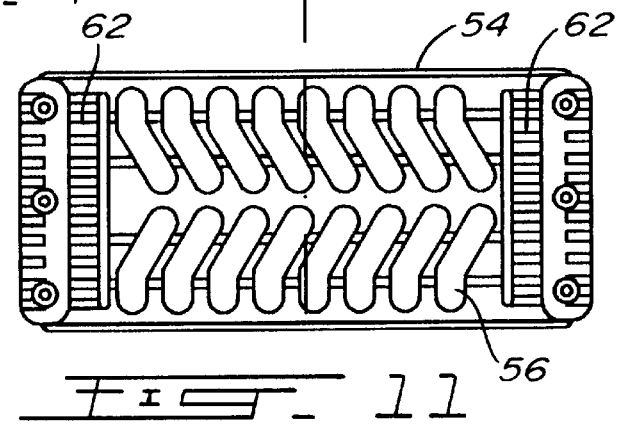
FIG. 11 is a bottom plan view of a sole of the spring member.
Figure 13:
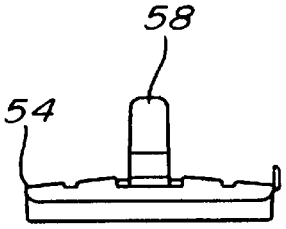
FIG. 13 is an end elevational view of the sole FIG. 11.
Figure 12:
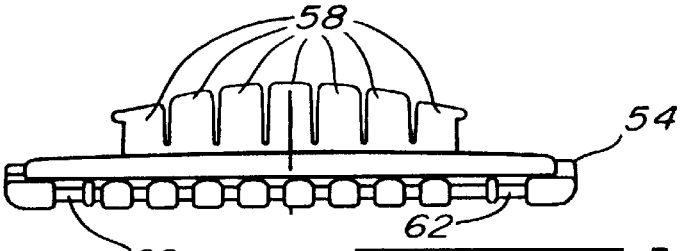
FIG. 12 is a side elevational view of the sole of FIG. 11.
Figure 5:
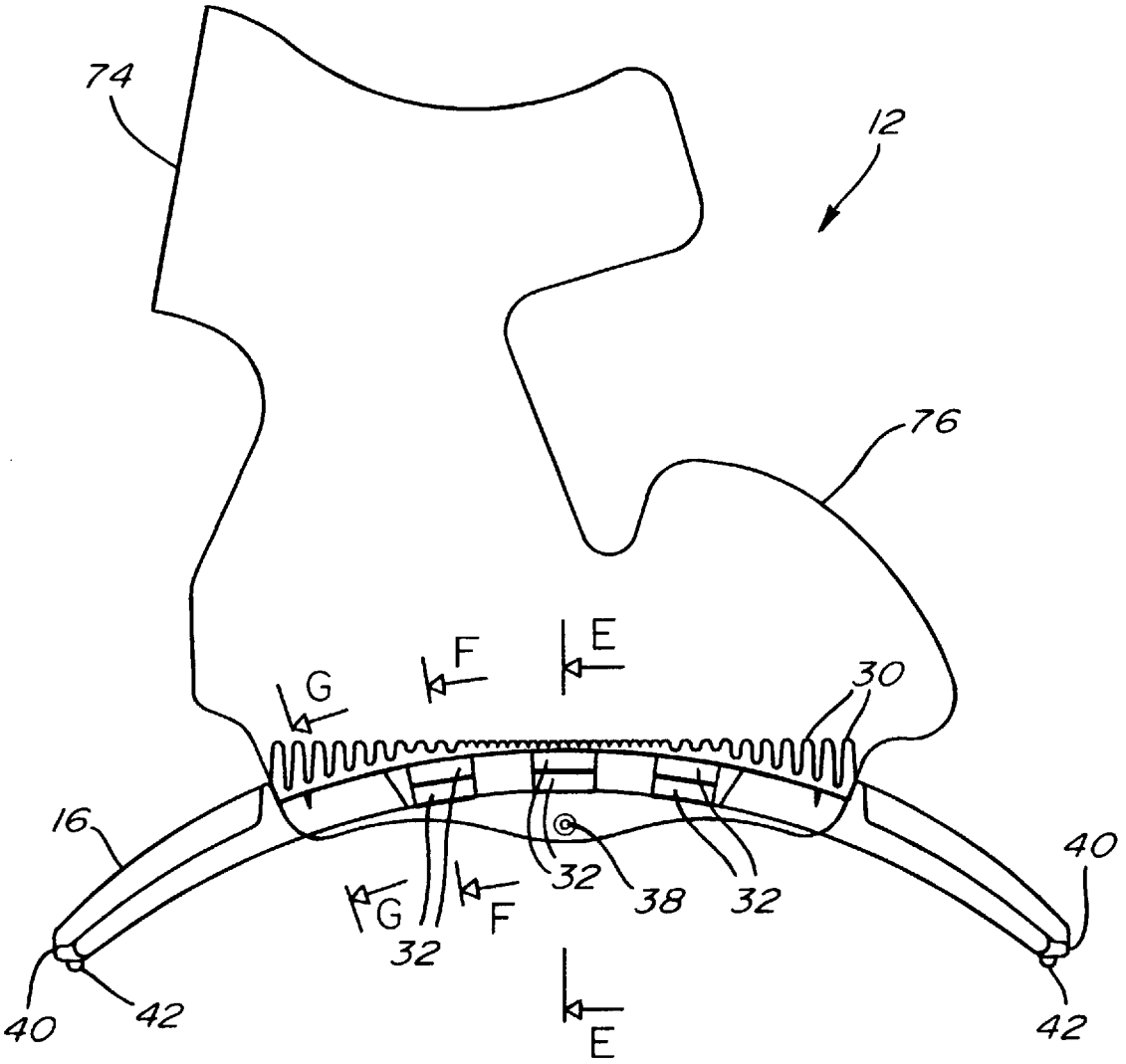
FIG. 5 is a side elevational view of the foot receiving member in a collapsed functional position and assembled to a top arcuate layer of the spring member.

A ground engaging sole 54 is detachably mounted to the bottom surface of the bottom arcuate layer 18. As shown in FIG. 11, the bottom of the sole 54 comprise a tread pattern 56 for providing a good grip of the sole 54 on the ground. The sole 54 is made of a flexible material having a high friction coefficient, such as rubber. An elongated interrupted vertical rib thereby defining plurality of protuberances 58 protrudes from the upper surface of the sole 54 and is adapted to be pressure fitted within a longitudinal slot 60 extending centrally in the bottom arcuate layer 18 (see FIG. 3).

Figure 4:
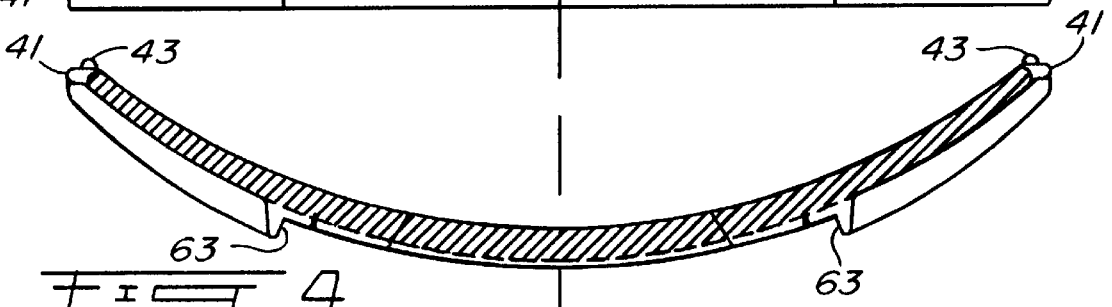
FIG. 4 is a vertical longitudinal cross-sectional view of the arcuate layer of FIG. 3.

The bottom surface of the sole 54 defines two transversal channels 62, as seen in FIG. 11, for receiving respective straps (not shown) which surround the sole 54 and the top arcuate layer 18 by extending along the bottom surface of the sole 54 and the top surface of the bottom arcuate layer 18 in a closed loop configuration thereby further securing the sole 54 to the bottom arcuate layer 18. The sole 54 is disposed centrally of the bottom arcuate layer 18 between two end abutments 63 (see FIG. 4) defined by the bottom surface of the bottom arcuate layer 18 to prevent longitudinal displacement of the sole 54 with respect to the bottom arcuate layer 18. The close fit of the protuberances 58 in the slot 60 also prevents any longitudinal displacement of the sole 54 relative to the bottom arcuate layer 18.

Turning now to FIGS. 2 and 14, the left portion 20 and the right portion 22 of the foot receiving member 14 are provided generally between the heel and the ankle of the user with a plurality of inwardly extending fins 64. These fins 64 are more or less located opposite the counter or the quarter of the user's footwear. The left and right portions 20 and 22 are also provided at the front thereof (i.e. substantially opposite the metatarsal portion of the foot) with a plurality of inwardly extending fins 66. As best seen in FIG. 14, the height of the fins 64 gradually decreases in the direction of arrow 68, i.e. towards the front of the foot receiving member 12. The height of the fins 66 gradually increase towards the front and finally decrease slightly as they reach the front of the foot receiving member 12. The fins 64 and 66 allow a same foot receiving member 12 to accommodate various shoe sizes. Therefore, the foot receiving member 12 can be manufactured in, for instance, only three different sizes (such as small, medium and large) while accommodating a wide range of foot or shoe sizes.

The foot receiving member 12 is designed to be worn over other footwear, such as shoes, boots or the like. Accordingly, the base portions 26 and 28 forming the sole 30 of the foot receiving member 12 are provided with a plurality of transversal ribs 70 to ensure a good grip of the outsole of the footwear on the sole 30. This is best seen in FIG. 2.

A foam-like pad 72 made of soft material is glued to the inner surface of the web portion 24 and to the upper ends of portions 20 and 22 for comfort purposes.

When the foot receiving member 12 is assembled to the top arcuate layer 16 as explained hereinbefore, the upper parts of the left and right portions 20 and 22 and the web portion 24 form a leg embracing portion 74 while the bottom parts of these left and right portions provide a foot containing portion 76. As schematically illustrated in FIG. 1, the leg embracing portion 74 and the foot containing portion 76 are provided with adjustable straps (not shown) which are retained in position by catches 78 for securing the exercise boot 10 to the leg and foot of the user in a manner well known in the art.

From the above it is easily seen that the construction of the foot receiving member 12 can accommodate a wide range of foot or shoe sizes and thus, for instance by way of fins 66, reduce the number of boot sizes to be manufactured.

Also, it is readily understood that manufacturing costs are reduced by having identical top and bottom arcuate layers 16 and 18, and by having a boot portion, i.e. the foot receiving member, molded in a single component.

The sole 54 and the strap 46 are easily replaceable when worn, with various straps being available to vary the spring force.

We claim:

1. An exercise boot comprising a foot receiving member and a spring member positioned under said foot receiving member, said foot receiving member being adapted for receiving a wearer's foot, said spring member comprising upper and lower resilient members and being adapted to be mounted with non rigid connection means to said foot receiving member at said upper resilient member such that said upper resilient member retains at least most of its springiness at said connection means.

2. An exercise boot comprising a foot receiving member and a spring member under said foot receiving member, said foot receiving member being formed of a flexible piece of material having left and right portions which, when forming a boot configuration, define a foot supporting base, and connection means for connecting said left and right portions to said spring member while retaining said left and right portions in said boot configuration.

3. An exercise boot as defined in claim 1, wherein said upper resilient member is retained captive in an arcuate longitudinal channel means defined in a base portion of said foot receiving member while being capable of limited longitudinal movement with respect to said base portion.

4. An exercise boot as defined in claim 1, wherein said non rigid connection means include hook means depending from said foot receiving member and adapted to engage slot means longitudinally defined in said upper resilient member for attaching said upper resilient member to said foot receiving member while allowing limited relative movement between said upper resilient member and said foot receiving member along said slot means.

5. An exercise boot as defined in claim 4, wherein said hook means include first and second sets of hook members inwardly extending from opposed longitudinal sides of a bottom portion of said foot receiving member and engaging said slot means.

6. An exercise boot as defined in claim 5, wherein each said hook member includes opposed upper and lower hooks adapted to receive therebetween a section of said upper resilient member outward of said slot means and to lockingly engage said slot means of said upper resilient member.

7. An exercise boot as defined in claim 1, wherein said foot receiving member is formed of a flexible piece of material having left and right portions, said left and right portions being provided with respective base portions extending substantially horizontally therefrom, and wherein said non rigid connection means include slot means defined in said upper resilient member and first and second hook means extending inwardly from respective base portions of said left and right portions for engaging said slot means thereby retaining said left and right portions in a boot like configuration, while at the same time attaching said upper resilient member to said foot receiving member.

8. An exercise boot as defined in claim 7, wherein said foot receiving member is constituted of a single molded piece of flexible material and said left and right portions are symmetrical.

9. An exercise boot as defined in claim 1, wherein second non rigid connection means are provided for attaching a ground engaging sole to an undersurface of said lower resilient member.

10. An exercise boot as defined in claim 9, wherein said second non rigid connection means include elongated rib means extending upwardly from said ground engaging sole and adapted to be pressure fitted in a longitudinal slot means defined in said lower resilient member.

11. An exercise boot as defined in claim 10, wherein said second non rigid connection means further include strap means tightly surrounding said lower resilient member and said ground engaging sole, and wherein an undersurface of said lower resilient member defines transversal channel means for receiving said strap means.

12. An exercise boot as defined in claim 2, wherein said connecting means include slot means defined in a top portion of said spring member and first and second hook means extending respectively inwardly from said left and right portions for engaging said slot means of said spring member.

13. An exercise boot as defined in claim 12, wherein said spring member has a substantially oval configuration, and wherein said slot means include a longitudinal slot extending substantially centrally along said top portion of said spring member.

14. An exercise boot as defined in claim 12, wherein said first and second hook means each include a set of parallel hook members, said hook members being integral with said foot receiving member.

15. An exercise boot as defined in claim 3, wherein said base portion of said foot receiving member includes left and right portions, and wherein fastener means extend transversally through said left and right portions of said base portion under said arcuate longitudinal channel means thereof for connecting said left and right portions together.

16. An exercise boot as defined in claim 2, wherein said left and right portions are symmetrical thereby forming in said boot configuration a boot which is symmetrical about a vertical plane extending through a longitudinal axis thereof.

17. An exercise boot comprising a foot receiving member and a spring member positioned under said foot receiving member, said foot receiving member being provided with resilient means extending inwardly from opposed lateral sides of said foot receiving member at a rear portion thereof, substantially opposite a counter of a user's footwear, said resilient means having a height which generally decreases towards a front portion of said foot receiving member thereby enabling said foot receiving member to accommodate various sizes of footwear.

18. An exercise boot as defined in claim 17, wherein said resilient means include a number of fin means integral to said foot receiving member.

19. An exercise boot as defined in claim 18, wherein said foot receiving member is provided at a front portion thereof with additional fin means extending inwardly from opposed lateral sides of said foot receiving member, substantially opposite a metatarsal portion of a wearer's foot, said additional fin means having a height which generally decreases towards said front portion of said foot receiving member.

20. An exercise boot as defined in claim 19, wherein said fin means and said additional fin means each include a plurality of substantially vertical fins.

* * * * *